United States Patent [19]

Ueda et al.

[11] Patent Number: 4,565,138

[45] Date of Patent: Jan. 21, 1986

[54] THERMAL DECOMPOSITION FURNACE OF WASTE TIRES

[75] Inventors: Yoshihiko Ueda, Chiba; Ikuo Saito, Tokyo; Kazumasa Sakae, Yachiyo; Tetuo Oogiri, Tokyo, all of Japan

[73] Assignee: Onoda Cement Co., Ltd., Japan

[21] Appl. No.: 689,461

[22] Filed: Jan. 7, 1985

Related U.S. Application Data

[63] Continuation of Ser. No. 557,332, Dec. 2, 1983, abandoned.

[30] Foreign Application Priority Data

Aug. 25, 1982 [JP] Japan ..... 57-147199

[51] Int. Cl.[4] ..... F23G 15/00

[52] U.S. Cl. ..... 110/346; 110/118; 110/245; 110/256; 110/264; 110/266; 122/4 D; 431/173

[58] Field of Search ..... 110/118, 235, 244, 245, 110/256, 257, 258, 264, 265, 266, 346; 122/4 D; 431/7, 170, 173

[56] References Cited

U.S. PATENT DOCUMENTS

| | | | |
|---|---|---|---|
| 2,483,728 | 10/1949 | Glaeser | 110/244 |
| 3,431,892 | 3/1969 | Crodel | 110/264 |
| 3,946,680 | 3/1976 | Laman | 110/257 |
| 4,203,804 | 5/1980 | Janning et al. | 110/245 |
| 4,372,228 | 2/1983 | Korenberg | 431/7 |
| 4,452,154 | 6/1984 | Kono et al. | 110/256 |

FOREIGN PATENT DOCUMENTS

| | | | |
|---|---|---|---|
| 112923 | 9/1980 | Japan | 110/235 |
| 23625 | 3/1981 | Japan | 110/244 |
| 26316 | 2/1982 | Japan | 110/118 |

*Primary Examiner*—Albert J. Makay
*Assistant Examiner*—Steven E. Warner
*Attorney, Agent, or Firm*—Price, Heneveld, Huizenga & Cooper

[57] ABSTRACT

A thermal decomposition furnace in which waste tires having original shape, not broken up, can be laid horizontally and be thermally decomposed. The furnace is constructed by providing a feeder above, forming downward a fluidized bed-forming section having inlets for air, forming beneath a sealing bed-forming section of right cylindrical shape having a diameter smaller than that of fluidized bed-forming section, and installing a conveyor below said sealing bed-forming section. At the lower end of sealing bed-forming section, an oblique opening is formed so as to keep a progressively increasing clearance to the conveyor in the direction of advance of conveyor.

1 Claim, 5 Drawing Figures

THERMAL DECOMPOSITION FURNACE OF WASTE TIRES

This is a continuation of application Ser. No. 557,332, filed Dec. 2, 1983, now abandoned.

This invention relates to thermal decomposition furnaces of waste tires for utilizing waste tires of automobile etc. as fuel for cement kiln, combustion chamber of bioler, dryer or broadly general uses.

In the prior art, verious types of thermal decomposition furnace for this purpose has been proposed, but none of them is satisfactory. In a prior method, as an example, wherein a deep fluidized bed furnace is employed for thermally decomposing waste tires, incombustible steel cords left cannot be discharged during continuous operation. Thus, one must take the trouble to break up waste tires into scraps of nearly equal size at the beginning.

It is intended by this invention to resolve these problems of the prior art. It is the principal object of this invention to provide a thermal decomposition furnace of waste tires which can thermally decompose waste tires as an original shape without breaking up waste tires. It is another object of the present invention to porvide a thermal decomposition furnace of waste tires in which a continuous operation, not an intermittent operation, can be performed. A further object of this invention is to porvide a thermal decomposition furnace of waste tires wherein the entire amount of heat in embers can be utilized whithout wasting. A specific object of the present invention is to provide a thermal decomposition furnace of waste tires in which no difficult procedures, such as removal of embers or seal cords from the high temperature interior of the furnace, are necessary.

It has been found by this invention that the above objects can be most suitably accomplished by providing a thermal decomposition furnace of waste tires which is characterized by comprising a body of thermal decomposition furnace adapted to receive waste tires having original shape, the inner diameter of said body being larger than the outer diameter of waste tire; a feeder adapted to charge a waste tire having original shape into said body from above; a fluidized bed-forming section formed in the lower part of said body, said fluidized bed-forming section being provided with inlets in the side wall; air pipes connected to said inlets and communicated with a blower; a sealing bed-forming section arranged beneath said fluidized bed-forming section; a conveyor disposed below said sealing bed-forming section; and an opening formed at the lower end of said sealing bed-forming section, the cut of said opening being so slanted that the distance from the upper surface of conveyor progressively increases in the direction of advancement of the conveyor.

Other objects and aspects of this invention will be understood from the following description taken in conjunction with the accompanying drawings wherein.

Figure 1:
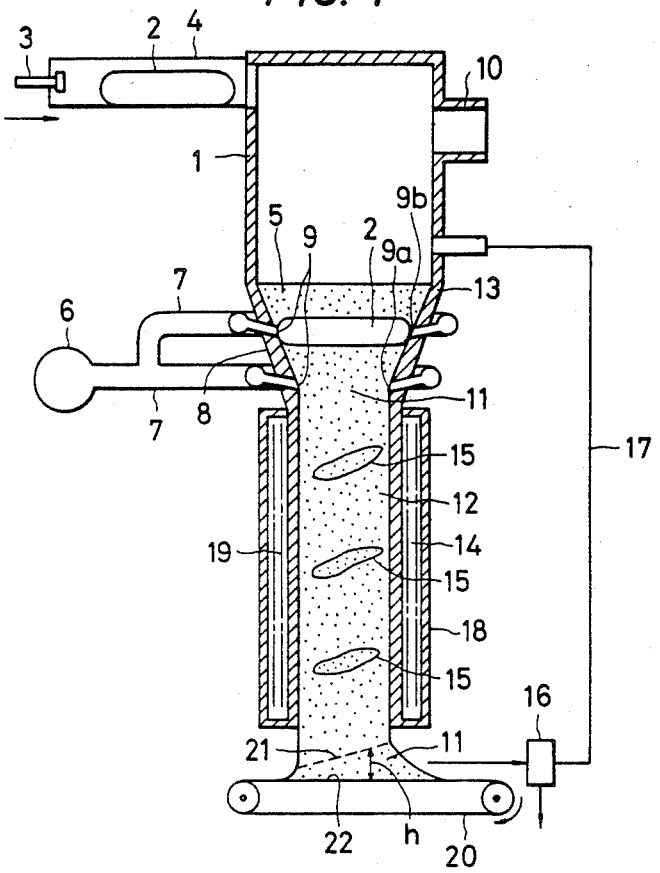
FIG. 1 is a sectional view which represents a scheme of one preferred embodiment of thermal decomposition furnace of waste tires according to this invention.

Referring now to the drawing, there is illustrated in FIG. 1, a body 1 of the thermal decomposition furnace. A waste tire 2 is passed through a charging chamber 4 by means of a feeder 3 and is thrown into the body 1 to be decomposed by heat in a fluidized bed 5. It is to be noted that, to commence operating the thermal decomposition furnace, the medium which will constitute the fluidized bed 5, such as silcia sand and cement clinker, must be preliminarily heated to about 600° C. or above. For the purpose of heating the medium, some waste tires 2 are preliminarily stacked in the fluidized bed 5 and are heated to burn. Then, the furnace is ready for operating.

The air for fluidizing the above-mentioned medium is fed from inlets 9 formed in the side wall 8 of body 1 via air pipes 7 by means of a blower 6. The gas which has been generated by thermal decomposition of waste tires 2 passes a duct 10 from the upper part of the body 1 and is blown into a combustion furnace not shown. This generated gas burns well in a combustion furnace because a large amount of CO, $H_2$, $CH_4$, $C_mH_n$ etc. are contained.

The thermal decomposition furnace is so constructed that the upward gas velocity in the space above the fluidized bed, when converted to it under normal condition, amounts to a value $v=0.1-0.5$ $Nm^3/sec$.

Figure 2:
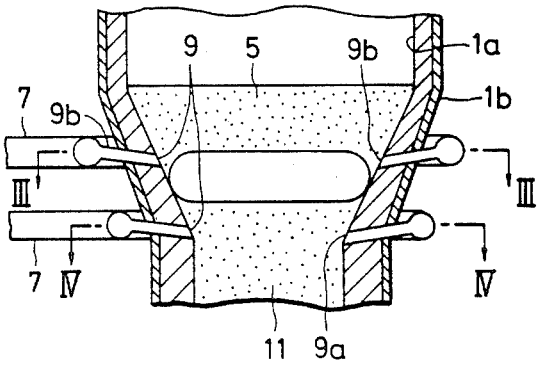
FIG. 2 shows the details, on enlarged scale, of an essential part of the furnace in FIG. 1.
Figure 3:
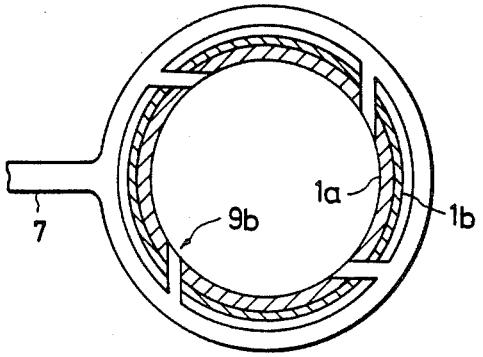
FIG. 3 shows a section taken along the line III—III of FIG. 2.
Figure 4:
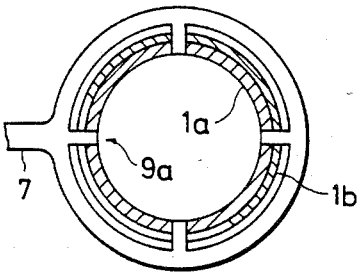
FIG. 4 shows a section taken along the line IV—IV of FIG. 2.

The generated gas includes carbon and the maximum diameter of carbon particle is ca. 1 mm. Thus, in the case of said combustion furnace being that of boiler etc., it is desirable that carbon is separated by means of a gas-solids separator, such as cyclone, and is returned to the fluidized bed 5 in the body 1 by way of a return line not shown to be decomposed thermally. The above-mentioned charging chamber 4 is provided with multiple dampers, not shown in the drawings, to form a sure seal. Accordingly, this apparatus allows charging of waste tires 2 during continuous operation. The above-mentioned inlets 9 of the air pipes 7 are arranged at two different heights as shown by 9*a* and 9*b* in FIGS. 1 and 2. In addition, lower inlets 9*a* are formed in the directions of radius of body 1 as shown by FIG. 4 and upper inlets 9*b* are formed in tangential directions as shown by FIG. 3. The lower inlets 9*a* feed air in an amount Ao ($Nm^3$/min.) required to fluidize the bed 5 and the upper inlets 9*b* feed air in an amount Aa ($Nm^3$/min.) required for gasification of waste tires. By regulating this air amount Aa with the use of a valve not shown, the throughput of waste tires is controlled. In order to maintain the normal operation of the furnace, the temperature of fluidized bed 5, as thermal decomposition temperature, is kept at a suitable point in the range of 600°-800° C. partly by adjusting the air amount through upper inlets 9*b*. As hereinafter stated, the aforementioned medium 11 is circulated and replaced by means of a return line arranged outside the body 1 according to this invention. The temperature of fluidized bed 5 is also controlled partly by regulating the amount of medium to be replaced. In addition, it is preferred that said inlets 5*a* and 5*b* are inclined downward toward the body 1, making an angle of 5° to 20° with the horizontal. In FIGS. 2, 3 and 4, reference numerals 1*a* and 1*b* indicate a refractory material and a casing, respectively. As shown in the drawings, a fluidized bed-forming section 13 is formed by slanted side wall 8 so as to have a smaller diameter at a lower position. By virture of this structure, the formed fluidized bed slides on the slanted surface and the fluidization is smoothly performed to obtain a uniform fluidized bed.

On the other hand, a sealing bed 12 is formed by medium 11 in the part below said inlets 9a. The sealing mechanism by this sealing bed 12 is due to packing of medium 11. Sealing is satisfactory when the air for forming the fluidized bed cannot blow through the sealing bed. Thus, it is preferred that the depth of sealing bed is made to be 2 to 5 timed the depth of the fluidized bed 5. The size of said medium is of 0.1 to 5 mm$\phi$, preferrably 0.2 to 1.2 mm$\phi$. The material of the medium should have heat resistance to about 1500° C. Employable materials are exemplified by refractories, such as cement clinker and silica sand. Reference numerals 13 and 14 indicate a fluidized bed-forming section and a sealing bed-forming section, respectively. The ratio of the vertical length between both forming sections is the same as the ratio of depth between the fluidized bed 5 and the sealing bed 12. The level of medium 11 of the fluidized bed 5 is so controlled that, when L denotes the depth of the fluidized bed 5 and D denotes the diameter of bed, the ratio L/D is kept in the range of $\frac{1}{2}$ to 2. To perform a normal operation with maintaining the level in position, charge and discharge amounts of medium 11 are regulated by maintaining the constant differences between a measured pressure at the top of furnace and measured pressures at some points of fluidized bed 5. The replacement of medium 11 in the fluidized bed is performed at the rate by which an amount of about $\frac{1}{2}$ to 3 times the volume of fluidized bed 5 is replaced per hour.

When a waste tire is thermally decomposed and passes through the fluidized bed 5, crude embers enveloping steel cord 15 are agitated and broken up by fluidized medium 5, soon are released from steel cord 15 by heat, are comminuted, and are passed to a combustion furnace along with the generated gas to be utilized for heating in combustion furnace. On the other hand, the above-mentioned steel cord moves downward with medium 11 in the sealing bed 12 as the medium 11 is drawn from the bottom of sealing bed 12. Steel cords are successively expelled to the outside with medium 11.

Then, steel cords 15 are separated from the medium by means of a separator 16, such as magnetic separator and grizzly, and the medium 11 is returned to the interior of the body 1 via a return line 17 arranged to discharge into the body. A water-cooling jacket is provided round the sealing bed-forming section 14 and water 19 within the jacket 18 chills the section. By virture of this chilling, the medium 11 and the steel cords 15 which have been drawn outside from the bottom of sealing bed 12 are at a lower temperature and the conveyor 20 or other installations for receiving these materials can be prevented from any heat damage. Further, the sealing bed-forming section 14 is constructed as nearly right cylindrical shape. Thus, the steel cord 15 as an original shape, i.e. not broken, can move downward without any trouble. In addition, the inner diameter of body 1 is made to be larger than the outer diameter of waste tire 2, and the inner diameter of sealing bed-forming section is made to be smaller than the outer diameter of waste tire 2. Accordingly, the separation of steel cords 15 from waste tires 12 is relatively secured.

Figure 5:
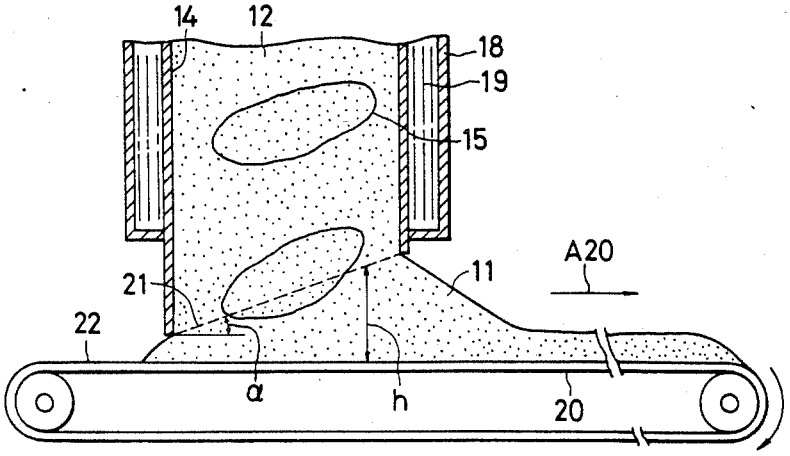
FIG. 5 represents an enlarged sectional view of another essential part of the furnace in FIG. 1.

Now, a brief mention will be made of an opening 21 of the aforementioned sealing bed-forming section 14. As can be seen from FIG. 5, the opening 21 is made so as to keep a distance h from the upper surface 22 of conveyor 20. The cut of opening 21 is so slanted that said distance h from the upper surface 20 of conveyor progressively increases as the viewpoint moves in the direction of advancement of the conveyor. Preferably, the angle of inclination $\alpha$ in FIG. 4 takes a vaule of 15 to 30 degrees. When $\alpha=0$, expelling of steel cord 15 becomes difficult. In contrast, when the cut of opening is formed to have an excessive angle of inclination, sealing is deteriorated.

The conveyor 20 advances in the direction of arrow A20. Thereby, medium 11 including steel cords 15 is drawn outside and the medium is separated from steel cords 15 by a separator 16. The resulting medium 11 is returned to the above-mentioned body 1 via the return line 17. Steel cords 15 are collected.

By virture of a thermal decomposition furnace being constructed as mentioned above according to the present invention, waste tires having an original shape can be thermally decomposed in continuous operation. The operation proceeds without the dificult procedure that embers and steel cords are raked out from high temperature surroundings of a furnace. Thus, the heat of embers can be entirely utilized.

What is claimed is:

1. A method for thermally decomposing waste tires including the steps of:

providing upper and lower bed sections communicating with each other and forming a vertical decomposition chamber;

filling the upper and lower sections with a granular refractory material to form a vertical column of such material;

fluidizing the granular material in the upper section by injecting air at two vertically spaced levels into the upper section, directing the air tangentially into the upper level of the upper section, and directing the air injected into the lower level toward the center of the upper section;

maintaining a condition capable of the thermal decomposition of tires in the upper section;

introducing uncommuniuted tires one at a time into the upper section;

restricting the rate of descent of the tires through the column of granular material and abrading any decomposition products from the unburnable parts of the tires by means of the granular material as the tire descends through the column, said restricting step including controlling the rate of descent of the tires through the upper section by progressively restricting in a downward direction the cross-sectional size of the upper section;

discharging the granular material and the unburnable materials of the tires through the bottom of the lower section onto a laterally moving conveyor, causing the granular material to flow onto the conveyor by progressively increasing the spacing from the conveyor of the lower end of the lower section in the direction of movement of the conveyor;

separating the unburnable materials from the granular material; and recycling the withdrawn granular material into the upper section.

* * * * *